US010309094B2

(12) United States Patent
Avelin et al.

(10) Patent No.: US 10,309,094 B2
(45) Date of Patent: Jun. 4, 2019

(54) BUILDING ACCESS SYSTEM AND A METHOD FOR PROVIDING A BUILDING WITH SUCH A BUILDING ACCESS SYSTEM

(71) Applicant: ARBRA HISSYSTEM AB, Arbra (SE)

(72) Inventors: Olof Avelin, Arbra (SE); Linnea Avelin, Stockholm (SE); Lars Erik Tallberg, Bollnas (SE)

(73) Assignee: ARBRA HISSYSTEM AB, Arbra (SE)

( * ) Notice: Subject to any disclaimer, the term of this patent is extended or adjusted under 35 U.S.C. 154(b) by 0 days.

(21) Appl. No.: 15/558,923

(22) PCT Filed: Mar. 16, 2016

(86) PCT No.: PCT/EP2016/055687

§ 371 (c)(1),
(2) Date: Sep. 15, 2017

(87) PCT Pub. No.: WO2016/146682

PCT Pub. Date: Sep. 22, 2016

(65) Prior Publication Data

US 2018/0073238 A1 Mar. 15, 2018

(30) Foreign Application Priority Data

Mar. 16, 2015 (SE) ..... 1550316

(51) Int. Cl.
*B66B 9/00* (2006.01)
*E04B 1/24* (2006.01)
(Continued)

(52) U.S. Cl.
CPC ..... *E04B 1/2403* (2013.01); *B66B 9/00* (2013.01); *B66B 11/0005* (2013.01);
(Continued)

(58) Field of Classification Search
CPC ..... E04B 1/2403; E04B 1/003; B66B 9/00; B66B 9/003; B66B 9/0846; B66B 9/0853;
(Continued)

(56) References Cited

U.S. PATENT DOCUMENTS 279,774 A * 6/1883 Letzkus ..... B66F 11/04 182/141
365,833 A * 7/1887 MacDonald ..... A62C 3/00 169/54

(Continued)

FOREIGN PATENT DOCUMENTS

DE 19916531 A1 2/2000
DE 102005050066 A1 * 5/2007 ..... B66B 9/04

(Continued)

OTHER PUBLICATIONS

International Search Report and Written Opinion for PCT/EP2016/055687, dated May 31, 2016, 9.

*Primary Examiner* — Kyle J. Walraed-Sullivan
(74) *Attorney, Agent, or Firm* — Johnson, Marcou & Isaacs, LLC; John M. Harrington, Esq.

(57) ABSTRACT

The invention relates to a building access system (100) adapted to be arranged externally of a building comprising a number of storeys, comprising an elevator module (2) with an elevator shaft (2A) for an elevator and a mounting arrangement (3) for mounting to a wall (4) of the building. The access system further comprises at least one balcony module (1,1) comprising one or more balconies (1A,1A,1A, 1B,1B,1B), each said balcony comprising a balcony door (16) for providing access to the elevator in a side wall (13). The balcony module (1,1) or modules comprises/comprise one or more separate modules adapted for connection to the building in association with the elevator module (2), or the elevator module and one or more balcony modules comprise an integrated elevator and balcony module. The mounting
(Continued)

arrangement (3) is adapted for interconnecting the balcony and elevator modules with the wall (4) of the building.

24 Claims, 12 Drawing Sheets

(51) Int. Cl.

| | |
|---|---|
| ***B66B 11/00*** | (2006.01) |
| ***E04B 1/00*** | (2006.01) |
| ***E04G 23/02*** | (2006.01) |
| ***B66B 19/00*** | (2006.01) |
| *A62B 1/02* | (2006.01) |

(52) U.S. Cl.
CPC ..... *B66B 19/00* (2013.01); *E04B 1/003* (2013.01); *E04G 23/0266* (2013.01); *A62B 1/02* (2013.01); *E04B 2001/2418* (2013.01); *E04B 2001/2451* (2013.01); *E04B 2001/2466* (2013.01)

(58) Field of Classification Search
CPC ..... B66B 9/16; B66B 9/187; B66B 2009/006; B66B 19/00; B66B 19/02; E04H 1/04; E04F 17/005; A62B 1/02; E04G 23/0266; E04G 3/28; E04G 2003/286; B66F 11/04; B66F 11/044; B66F 11/046
USPC ..... 52/29–30; 187/401, 406, 409, 900
See application file for complete search history.

(56) References Cited

U.S. PATENT DOCUMENTS

| | | | | | |
|---|---|---|---|---|---|
| 461,499 | A * | 10/1891 | Ernst | B66F 11/04 | 182/141 |
| 708,838 | A * | 9/1902 | Sferlozza | B66F 11/04 | 182/101 |
| 780,711 | A * | 1/1905 | Donell | B66F 11/04 | 182/141 |
| 783,063 | A * | 2/1905 | McClay | A62B 1/02 | 182/18 |
| 916,825 | A * | 3/1909 | Alspach | A62B 1/02 | 182/44 |
| 919,721 | A * | 4/1909 | Hegedus | B66F 11/04 | 182/141 |
| 1,053,425 | A * | 2/1913 | Metzler | B66F 11/04 | 182/141 |
| 1,392,660 | A * | 10/1921 | Sebestakowicz | A62B 1/02 | 182/141 |
| 1,615,753 | A * | 1/1927 | Gilowitz | A62B 1/02 | 182/141 |
| 1,725,677 | A * | 8/1929 | Stanley | A62B 1/02 | 212/337 |
| 2,936,083 | A * | 5/1960 | Dahlman | E04H 6/282 | 187/239 |
| 3,945,469 | A * | 3/1976 | Dorcich | A62B 1/00 | 182/142 |
| 3,954,185 | A * | 5/1976 | Wentz | B65G 1/0407 | 414/286 |
| 4,406,351 | A * | 9/1983 | Littlejohn | A62B 1/02 | 182/142 |
| 4,469,198 | A * | 9/1984 | Crump | B66B 9/00 | 169/48 |
| 4,640,384 | A * | 2/1987 | Kucher | B66B 9/00 | 182/142 |
| 4,664,226 | A * | 5/1987 | Centanne | A62B 1/02 | 182/141 |
| 4,865,155 | A * | 9/1989 | Montaigne | A62B 1/02 | 182/14 |
| 5,127,491 | A * | 7/1992 | Just-Buddy | A62B 1/00 | 182/142 |
| 5,253,734 | A * | 10/1993 | Laurutis | A62B 1/02 | 187/239 |
| 5,377,778 | A * | 1/1995 | Lan | A62B 1/20 | 182/100 |
| 5,392,877 | A * | 2/1995 | Shahin | A62B 1/02 | 182/82 |
| 6,029,773 | A * | 2/2000 | Herrera-Casasus | A62B 1/20 | 182/100 |
| 6,318,503 | B1 * | 11/2001 | Hernandez | A62B 1/02 | 182/144 |
| 7,191,873 | B2 * | 3/2007 | Korchagin | B66B 9/16 | 182/141 |
| 8,151,941 | B2 * | 4/2012 | Moses | B66B 9/187 | 182/37 |
| 8,381,879 | B2 * | 2/2013 | Griffin | B66B 9/00 | 187/261 |
| 2004/0195045 | A1 * | 10/2004 | Richey | B66B 9/00 | 187/239 |
| 2005/0087393 | A1 * | 4/2005 | Korchagin | B66B 9/16 | 182/131 |
| 2006/0144639 | A1 * | 7/2006 | Iacoviello | A62B 1/02 | 182/82 |
| 2008/0190706 | A1 * | 8/2008 | Franklin | B66B 9/027 | 187/251 |
| 2013/0081902 | A1 * | 4/2013 | Liao | E04G 3/28 | 182/20 |
| 2018/0009630 | A1 * | 1/2018 | Depaola, Jr. | B66B 1/30 | |
| 2018/0029832 | A1 * | 2/2018 | Fargo | B66B 11/0213 | |
| 2018/0051521 | A1 * | 2/2018 | Ledet | E21B 15/00 | |

FOREIGN PATENT DOCUMENTS

| | | | |
|---|---|---|---|
| JP | H11256691 | A | 9/1999 |
| JP | 2004225473 | A | 8/2004 |

* cited by examiner

BUILDING ACCESS SYSTEM AND A METHOD FOR PROVIDING A BUILDING WITH SUCH A BUILDING ACCESS SYSTEM

CROSS REFERENCE TO RELATED APPLICATIONS

This application is a 35 U.S.C. § 371 national stage of International Application No. PCT/EP2016/055687 filed on Mar. 16, 2016, published in English under PCT Article 21(2), which claims the benefit of priority to Swedish Patent Application No. 1550316-2 filed on Mar. 16, 2015, the disclosures of which are hereby incorporated by reference.

TECHNICAL FIELD

The present invention relates to a building access system having the features of the first part of claim 1. The invention also relates to a method for providing a building with a building access system having the features of the first part of claim 25.

BACKGROUND

In recent times the requirements on buildings, e.g. multi-tenant buildings with several storeys, but also buildings with one or a few storeys only, being equipped with means admitting easy access for everyone by means of elevators are increasing. These requirements make the buildings more expensive since elevator arrangements are costly installations. Particularly if the building only comprises two, three or four floors, the conclusion might be that it is not worth the price installing an elevator arrangement at all.

This problematic is even more pronounced within the existing building stock, particularly for residential buildings, since it not only involves considerable investments to provide existing, e.g. older buildings with elevator arrangements. Such buildings are generally not adapted for receiving an elevator arrangement, and a considerable reconstruction of the building may be required, since such an installation is very space demanding. It may for example require using some of the available space normally used for apartments close to the staircase. Elevator arrangements must also be so located that easy access is provided for each apartment in the building.

These factors may in some instances even make it questionable whether it is worth the investment to equip an existing building with an elevator.

A more attractive alternative may in such a case be to demolish the building and instead construct new buildings equipped with elevator arrangements.

JPH1135254 proposes a home elevator for installation in an existing one or two-family building. It comprises an open deck on a lower floor and a veranda on an upper floor and is arranged for connection to an exterior wall on the window side of an existing house. Entrance is provided through respective landings. The elevator room goes up and down between the floors Entrance is provided through sliding doors to the veranda and the open deck. Such an arrangement is limited to be used for a one-family house, and in particular there is no safe connection to the building.

DE 102005050066 shows a system wherein a separate supporting structure, with supporting elements resting on the ground, and cross bars connected thereto, is arranged to support a number of balconies, such that all vertical loads on the balconies are taken up thereby. An elevator arrangement uses the same supporting structure as the balcony arrangement, and the elevator runs via rails connected to the supporting structure. Since buildings move with respect to the ground, or vice versa, several problems may be associated with such a construction. It is also a disadvantage of such a system that the provisioning of a soil foundation is not always desirable, or even possible.

It is also known to equip existing residential buildings with external elevator arrangements. Such external elevator arrangements are then built in connection to existing staircases, where a wing is built out next to each stairwell. This is an extremely expensive and space demanding alternative, which also is very time consuming to build and install, and out of question where available external space is limited, e.g. in areas where the building stock is dense.

Thus, the option based on existing solutions is to undertake an expensive, time-consuming installation, requiring space that for example normally is used as living areas, for the installation, which may reduce the size of existing living areas or other localities, e.g. offices or anything else, and is very costly. It may be so costly that it requires increasing the costs for the apartments, offices or similar that is not acceptable to tenants or owners.

The alternative would be either to demolish the building, or to leave it as it is, which may be unsatisfactory, in particular if other renovation measures are to be undertaken, since the standard of the building will then not be increased to a level corresponding to the costs for taking such other measures.

Also for the building of new houses it is sometimes a disadvantage that the costs and the space demanded for equipping the buildings with an elevator are unnecessarily high, e.g. if low-cost alternatives are to be built, or for more temporary buildings, which then may have to be built without an easy access facility comprising an elevator.

Particularly considering the fact that residential densification in urban areas is becoming more and more attractive at the same time as there is a need for less expensive apartments, further at the same time as the requirements on access facilities are increasing, it is realized that none of the existing solutions is satisfactory.

SUMMARY

It is therefore an object of the present invention to provide a building access system as initially referred to through which one or more of the above mentioned problems can be solved.

A particular object is to provide a building access system which is less space demanding than hitherto known access systems comprising an elevator facility.

It is particularly an object to provide a building access system which is cheap and which is easy and uncomplicated to install on a building, and which further meets high safety standards, in use as well as during mounting.

It is a particular object to provide a building access system which can be installed without demanding access to, and reducing available internal space on existing buildings, neither living areas, nor in the stairwells.

Still further it is a particular object to provide building access system which is easy to fabricate and to mount.

It is a particular object to provide a building access system which is easy to transport to the building where it is to be mounted.

Still another object is to provide a building access system which can be mounted in a fast manner.

Another particular object is to provide a building access system which is flexible, which with advantage can be used when building new buildings, and also for existing buildings, independently of whether they are equipped with balconies or not, and substantially independently of how apartments, offices etc. are organized in the building.

Still other objects are to provide a building access system which meets high security standards and further which is aesthetic and comfortable for the residents of the building.

Therefore, a building access system as initially referred to is provided which has the characterizing features of claim 1.

It is also a particularly an object to provide a method for providing a building with an access system having the features of the first part of claim 25 through which one or more of the above mentioned objects can be met.

Therefore, a method is provided which has the characterizing features of claim 25.

Advantageous embodiments are given by the respective appended sub-claims.

BRIEF DESCRIPTION OF THE DRAWINGS

The invention will in the following be further described, in a non-limiting manner, and with reference to the accompanying drawings, in which.

DETAILED DESCRIPTION

Figure 1:
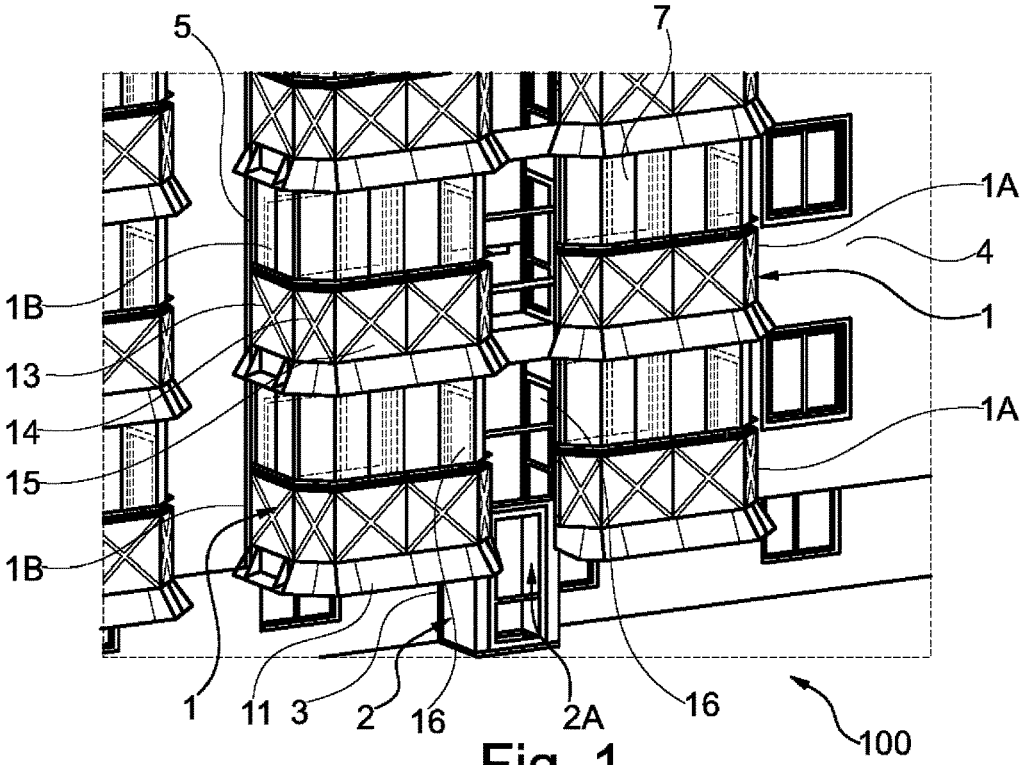
FIG. 1 is a schematic view of an access system according to one embodiment of the invention, comprising an elevator module surrounded by balconies on two sides thereof as mounted on an external wall of a building.

FIG. 1 shows a section of a building access system 100 comprising an elevator module 2 with an elevator shaft 2A for an elevator and two balcony modules 1,1 disposed on two opposite sides of the elevator module 2. Each balcony module here comprises three (shown) balconies 1A, 1A, 1A; 1B, 1B, 1B, where the balconies of a respective module are disposed vertically one above another. It should be clear that in other implementations, each specific balcony may comprise a separate module separately mounted and connected to the/an elevator module, and to a mounting arrangement. In other embodiments the access system may comprise an integrated module comprising an elevator module and a number of balconies or balcony modules disposed on one side of the elevator module in one or more planes.

In still other embodiments, balcony modules, for one or more storeys or planes, may be provided which are adapted to be disposed on one side only, or even on three sides, of an elevator module. It should also be clear that balconies disposed on two or more sides of an elevator module may be disposed in parallel planes, or in planes which are not parallel, but e.g. vertically displaced (in a mounted state) with respect to one another. The number of planes may also be different on different sides. Such and other different implementations and variations are of course also to be covered by the present invention if the building access system comprises separate modules; i.e. the elevator modules and balconies or balcony modules are not integrated, or integrated in different manners, e.g. one module comprising an elevator module and one, two or three balconies, or balcony modules, for each plane, cf. examples in FIGS. 4A-4D.

In FIG. 1 is schematically illustrated a mounting arrangement 3 comprising so called vertical structural hollow sections (only one shown in FIG. 1) mounted to the external wall 4 of a building, to which mounting arrangement 3 the two three-plane balcony modules and an elevator module 2 are mounted, on rear side edges thereof. Each balcony comprises a balcony door 16 provided in a side wall 13 of the respective balcony for providing access to the elevator running in the elevator shaft 2A. In FIG. 1 also front walls 15 and optional corner walls 14 of the balconies are shown. It should be clear that the mounting arrangement alternatively may comprise other elements than vertical structural hollow sections, e.g. vertical elements which are not hollow, and that such elements, irrespectively of hollow or not, may have any appropriate cross-section, e.g. square shaped, rectangular etc.

In the shown embodiment the balconies are provided with water protective arrangements 11 as will be further described below with reference to FIGS. 9-10. Water protective arrangements are of course not necessary for the functioning of the inventive concept, and may, if provided at all, be of any other kind.

The mounting arrangement 3 is connected to the wall 4 of the building as will be further described below.

It should also be clear that the inventive concept is not limited to any particular kind of mounting arrangement, but that the modules, separately, or as one or more integrated modules, may be connected to an external wall of a building in any appropriate manner. The mounting arrangement may alternatively, or additionally, be connected to mounting elements, also denoted second, suspending, mounting elements, of different kinds and arranged in different manners. The mounting arrangement may then e.g. be connected thereto and exclusively or additionally supported thereby, whereby such second, suspending, mounting elements may comprise bars or beams forming part of, or being fixedly connected to, the attic joist floor, or to the wall of the building. Still further, separate, e.g. different, mounting arrangements or elements may be used for elevator modules and balcony modules, and the elevator modules may be supported and carried by means of soil foundations, whereas the balcony modules are connected to the building, in the sense of carried and supported thereby via the part of the mounting arrangement connected to and supported thereby.

Further, balcony should be interpreted in a broad sense; it may e.g. in some instances, at least at the bottom floor, be a veranda, a terrace or similar; it may also relate to any kind of platform etc. Still further it does of course not have to be a glass balcony, it may alternatively comprise one or more solid walls, railings etc. The balcony door may in some embodiments comprise but a door in a balcony railing or a door of semi-height, on condition that there is a door in the elevator shaft which is closed except for when the elevator arrives. Different kinds of elevators may also be used. The elevator module may be exclusively mounted to the wall, or provided with additional supports as well, but which does not require any real fundament, or catch trap, although the use of such elevators of course is not excluded. Alternatively, the elevator module is supported, solely or additionally, by a fundament on the ground or a soil foundation of any appropriate kind, whereas the balcony module(s) is/are connected to the building. An inner balcony door 7, leading to the living area, is illustrated by means of dashed lines.

Figure 2:
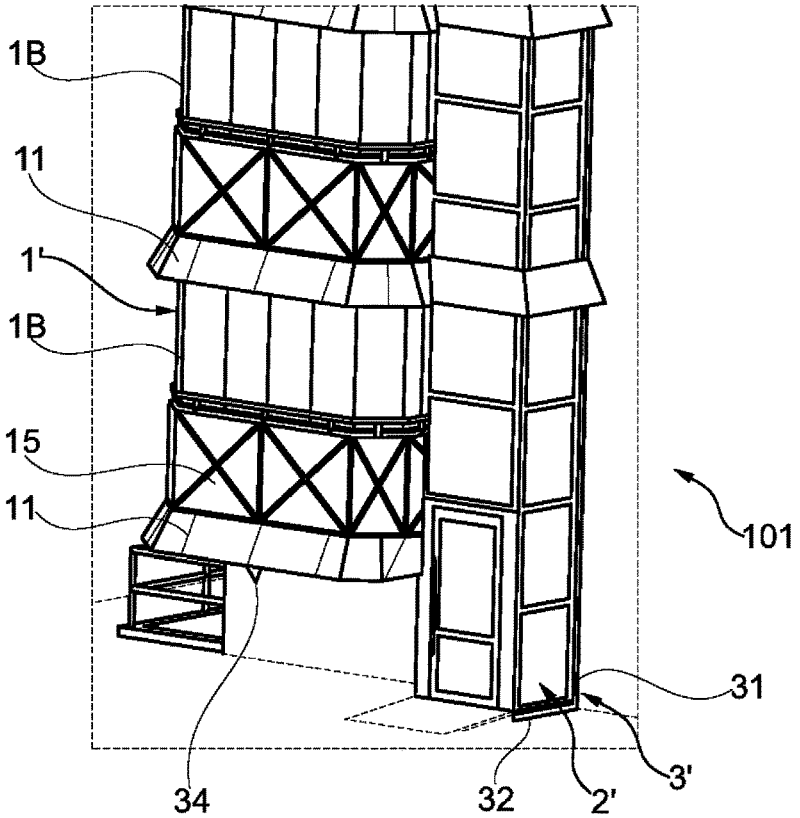
FIG. 2 is a schematic view of an access system according to another embodiment of the invention, comprising an elevator module with a multi-storey balcony module on one side thereof as mounted on an external wall of a building.

FIG. 2 shows an alternative access system 101 according to the invention which comprises an elevator module 2' comprising an elevator shaft for an elevator and a balcony module 1' comprising a number of balconies 1B,1B disposed vertically one above another. It should be clear that each balcony also may be comprised by a separate balcony module, in which case there are a plurality of balcony modules disposed in association with the elevator module 2', on one and the same side thereof. Like elements bear the same reference numbers as in FIG. 1, and will not be further described.

The mounting arrangement 3' comprises two first vertical structural hollow sections (only one shown) adapted for connection of the elevator module 2' to the house wall 4. Each first vertical structural hollow section is L-shaped with a first leg section 31 adapted to interconnect the elevator module 2' with the house wall 4 in a vertical direction, and a second leg section 32 perpendicularly disposed with respect to the first leg section 31 and adapted to be disposed at a respective lower side edge of the elevator module 2'.

In FIG. 2 a supporting element 34 of a second mounting element (not shown in FIG. 2) of the mounting arrangement according to one embodiment is indicated, which here serves the purpose of mounting/connecting at least a side of the balcony module 1' which faces away from the elevator module 2' to the wall 4.

Figure 3:
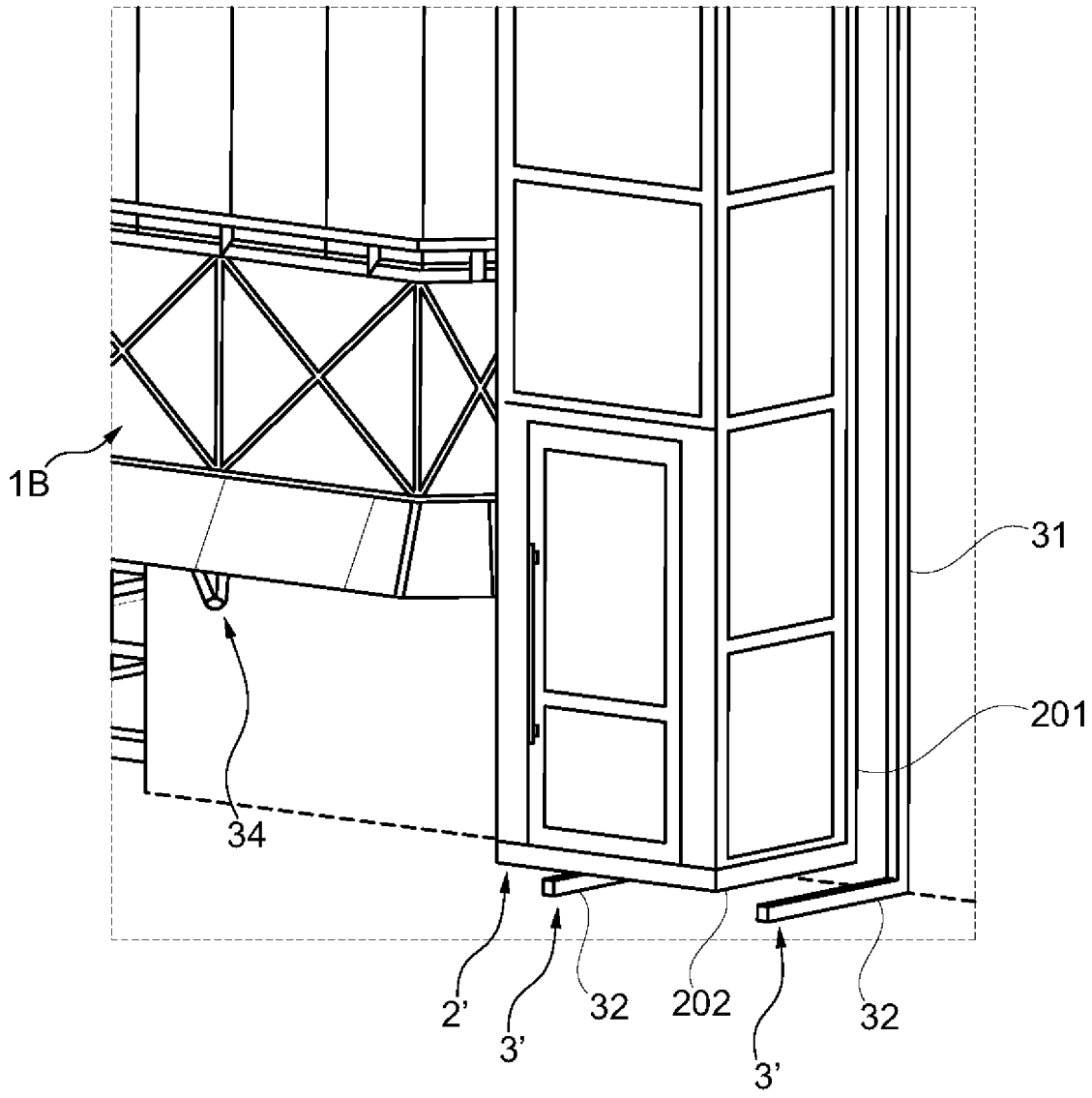
FIG. 3 is a simplified perspective view of an access system as in FIG. 2 in an enlarged scale with the elevator module in a position for connection to the house wall for illustrative purposes.

FIG. 3 is an enlarged partial view of the access system 101 shown in FIG. 2. For explanatory reasons the elevator module 2' is illustrated in a state just before mounting to the mounting arrangement 3' connected to the house wall 4. Thus, here the rear outer side edges 201 of the elevator module 2' are to be connected to the first leg section 31 whereas the lower outer side edges 202 thereof are to be connected horizontally, or vertically, and hence rest on, the second leg section 32.

In an alternative embodiment (not shown) the first vertical structural hollow sections are integrated in the elevator module for attachment together with the elevator module to a house wall. Also for integrated building access systems the mounting arrangements may be partly or wholly integrated with the building access system; alternatively, the mounting arrangements are separate therefrom, and in still other embodiments parts of the mounting arrangement are integrated, other parts not. In exemplary embodiments mounting arrangements are integrated in an elevator module forming part of an integrated module. Many variations are possible.

Figure 3A:
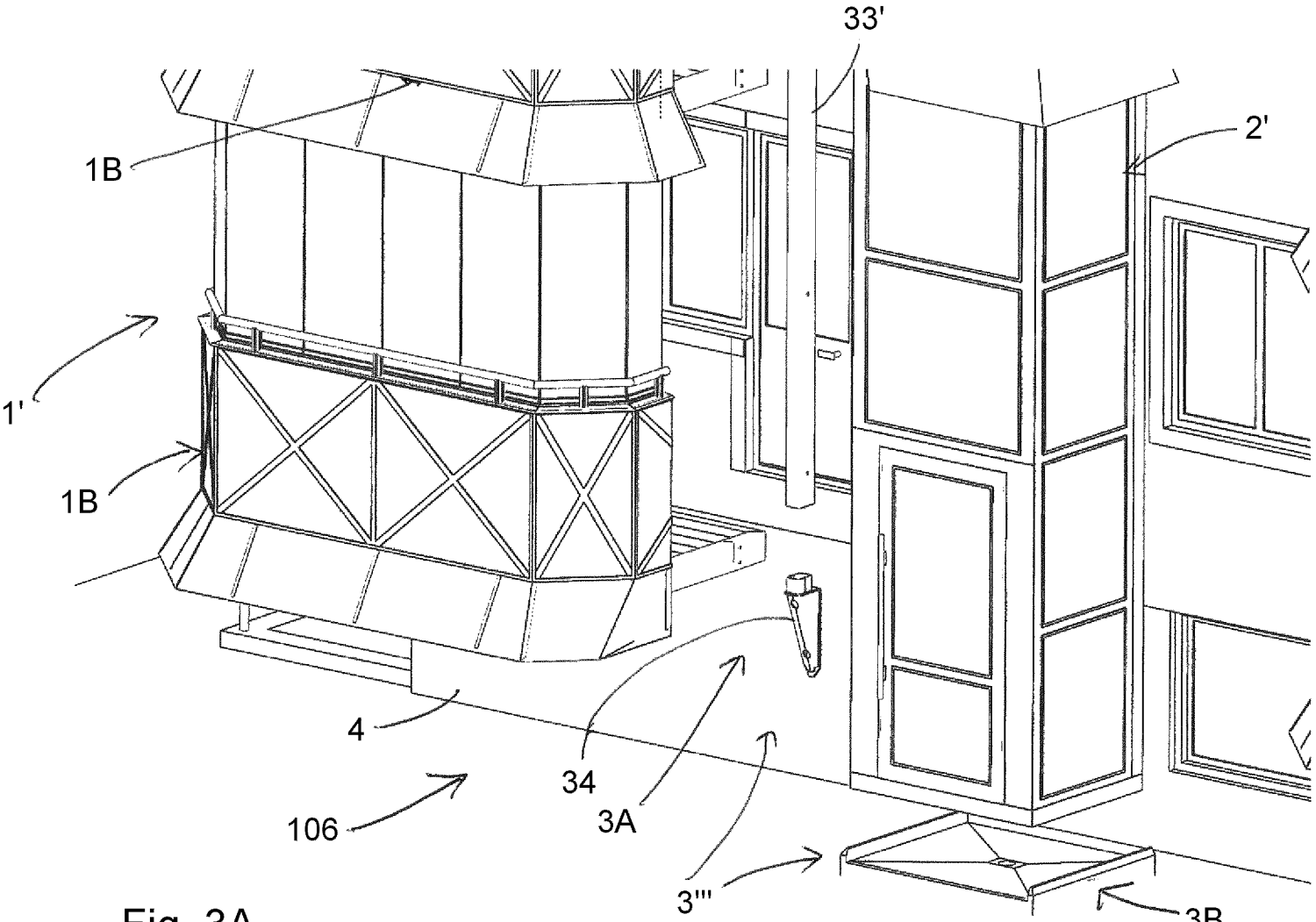
FIG. 3A is a simplified perspective view of a section of an alternative access system with the elevator module in a position for connection to a soil foundation and the balcony module in position for mounting to the wall via the mounting arrangement.

FIG. 3A shows an alternative access system 106 according to the invention which comprises an elevator module 2' comprising an elevator shaft for an elevator and a balcony module 1' comprising a number of balconies 1B, 1B disposed vertically one above another. It should be clear that each balcony also may be comprised by a separate balcony module, in which case there are a plurality of balcony modules disposed in association with the elevator module 2', on one and the same side thereof. Like elements bear the same reference numbers as in FIG. 1, and will not be further described.

The mounting arrangement 3''' here comprises at least partly separate mounting arrangement structures 3A, 3B for the balcony module 1' and for the elevator module 2'. The first mounting arrangement structure 3A comprises two first vertical structural hollow sections 33' (only one shown), see e.g. FIGS. 7B, 7C, adapted for connection of the balcony module 1' to the house wall 4. Each first vertical structural hollow section 33' is supported by a console element 34 e.g. as described with reference to FIG. 7B or any other console element, or no console element at all. The elevator module 2' is here arranged to be supported or carried by a fundament disposed on, or in, the ground, e.g. a soil foundation 3B. The elevator module 2' may additionally be connected to the building, e.g. the wall 4 and/or the balcony module, e.g. via the first mounting arrangement structure 3A, for connection, but not carrying, purposes and for keeping it in place on the wall and with respect to the balcony module.

For explanatory reasons the elevator module 2' is illustrated in a state just before mounting to the mounting arrangement 3''' connected to the house wall 4 and ground respectively.

Figure 3B:
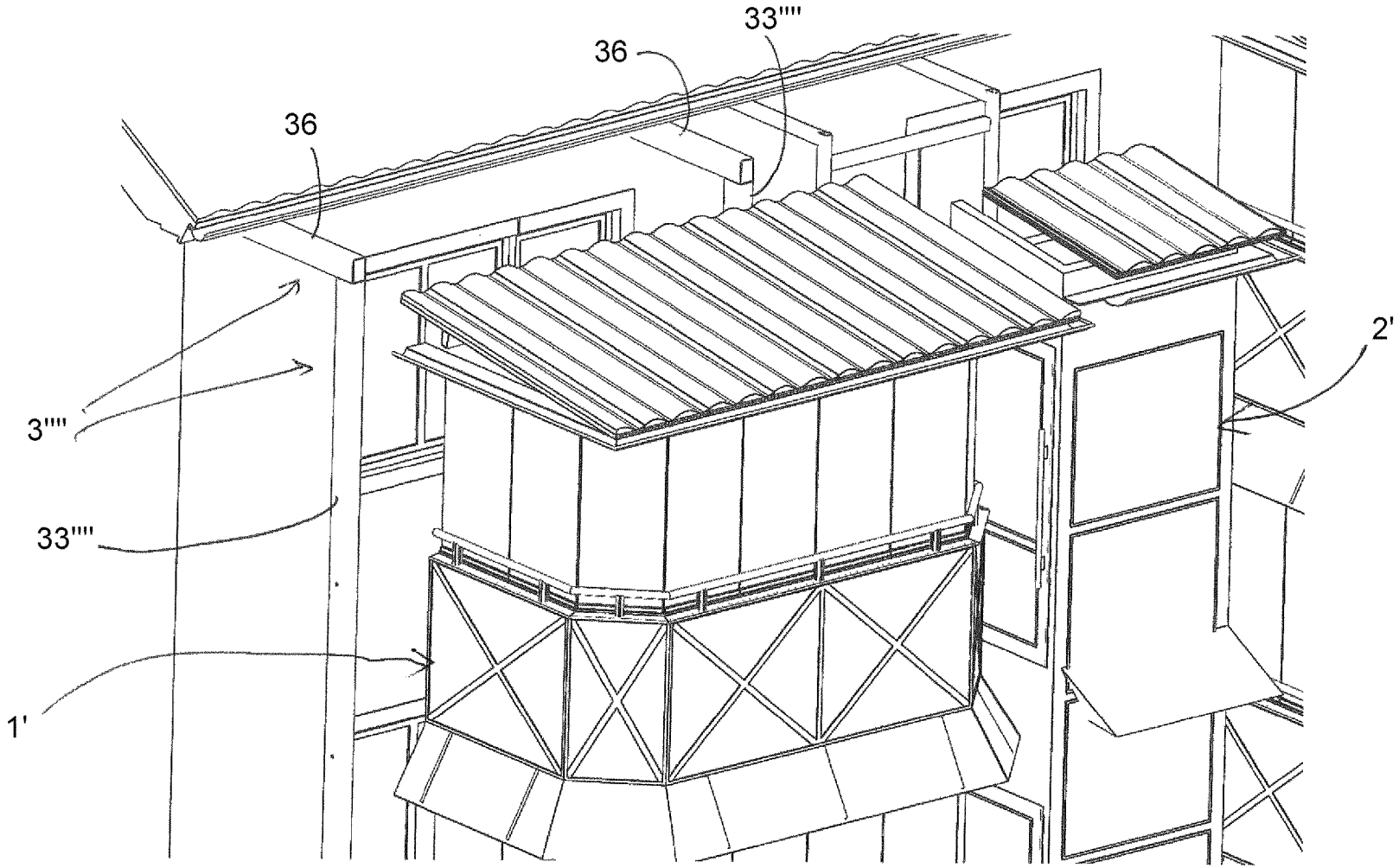
FIG. 3B is a simplified perspective view of a section of an alternative access system in a position for connection to mounting elements connected to an attic joist floor of the building.

FIG. 3B shows another alternative access system 107 according to the invention which comprises an elevator module 2' comprising an elevator shaft for an elevator and a balcony module 1' comprising a number of balconies 1B, 1B disposed vertically one above another. It should be clear that each balcony also may be comprised by a separate balcony module, in which case there are a plurality of balcony modules disposed in association with the elevator module 2', on one and the same side thereof. Like elements bear the same reference numbers as in FIG. 1, and will not be further described.

The mounting arrangement 3"" here comprises second, suspending, mounting elements 36, 36, e.g. comprising bars or beams forming part of or being fixedly connected to the attic joist floor of the building (or in alternative embodiments, not shown, to the wall of the building). The first vertical structural hollow sections 33"", 33"" are connected to, and e.g. suspended by the second, suspending, mounting elements 36, 36.

For explanatory reasons the elevator module 2' is illustrated in a state just before mounting to the mounting arrangement 3"" in FIG. 3B, and the second, suspending, mounting elements 36, 36 are shown as being drawn out from the wall or attic of the building for illustrative purposes, in real they do only protrude a sufficient distance for allowing mounting of the first vertical structural hollow sections 33"", 33"". In one embodiment, also the elevator module 2' is connected and suspended by means of second suspending mounting elements, common with, or separate from, the second, suspending, mounting elements 36, 36.

The elevator module 2' may alternatively be arranged to be supported or carried by a soil foundation 3B as in FIG. 3A, or as described with reference to any other described embodiment.

Figure 4A:
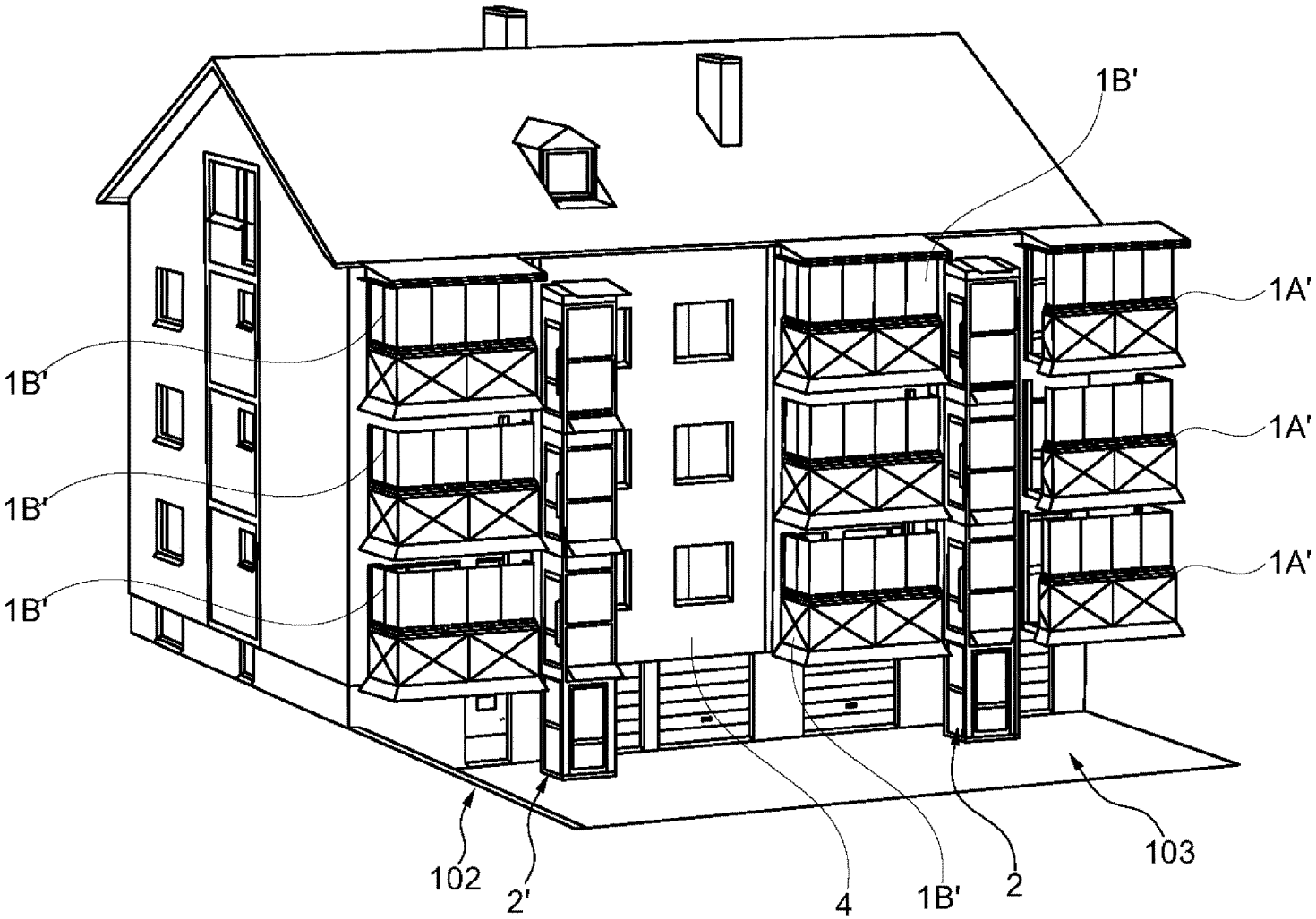
FIG. 4A shows exemplary access systems comprising an elevator module and separate balcony (sub-) modules in a position for mounting on a wall of a building.

FIG. 4A schematically shows a building access system 102 with an elevator module 2' similar to the elevator module shown in FIG. 3. It comprises an entrance plane and three planes for association with, in this embodiment, three separate balcony modules 1B', 1B', 1B' provided on one side thereof. It also shows an access system 103 with an elevator module 2 similar to the elevator module shown in FIG. 1 but with six balconies formed by each a separate balcony module 1A', 1A', 1A', 1B', 1B', 1B' arranged to be mounted in three planes on two sides of the elevator module 2. Thus, in this embodiment, each balcony comprises a separate module, and the elevator module is an integrated module for a plurality of vertical planes. The balcony modules and the elevator modules are shown in position for being mounted onto the wall 4 of a building.

Figure 4B:
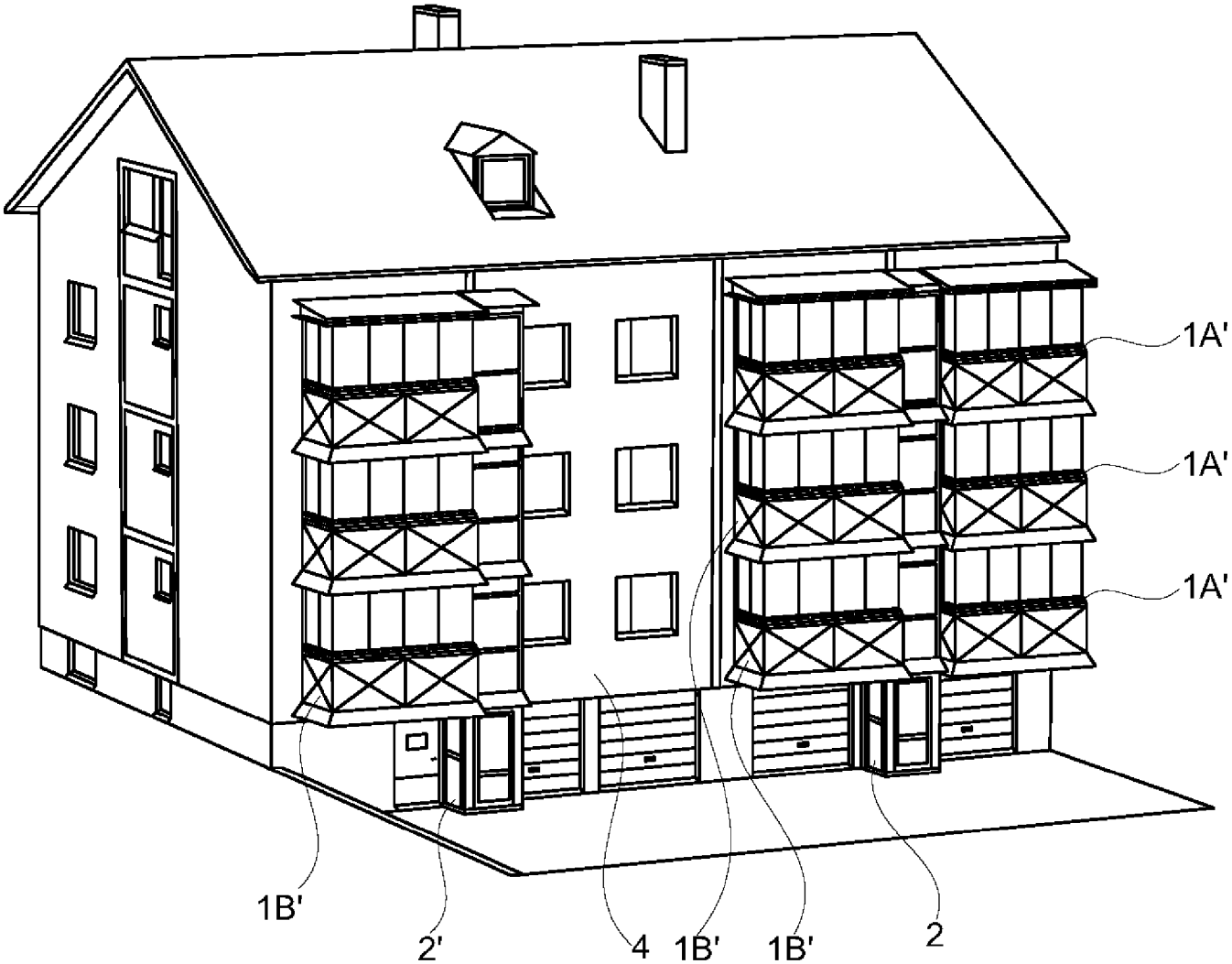
FIG. 4B shows the access systems of FIG. 4A in a mounted state on the wall.

In FIG. 4B the balcony modules 1B', 1B', 1B'; 1A', 1A', 1A', 1B', 1B', 1B' and the elevator modules 2', 2 are shown in a mounted state on the wall 4 of the building.

Figure 4C:
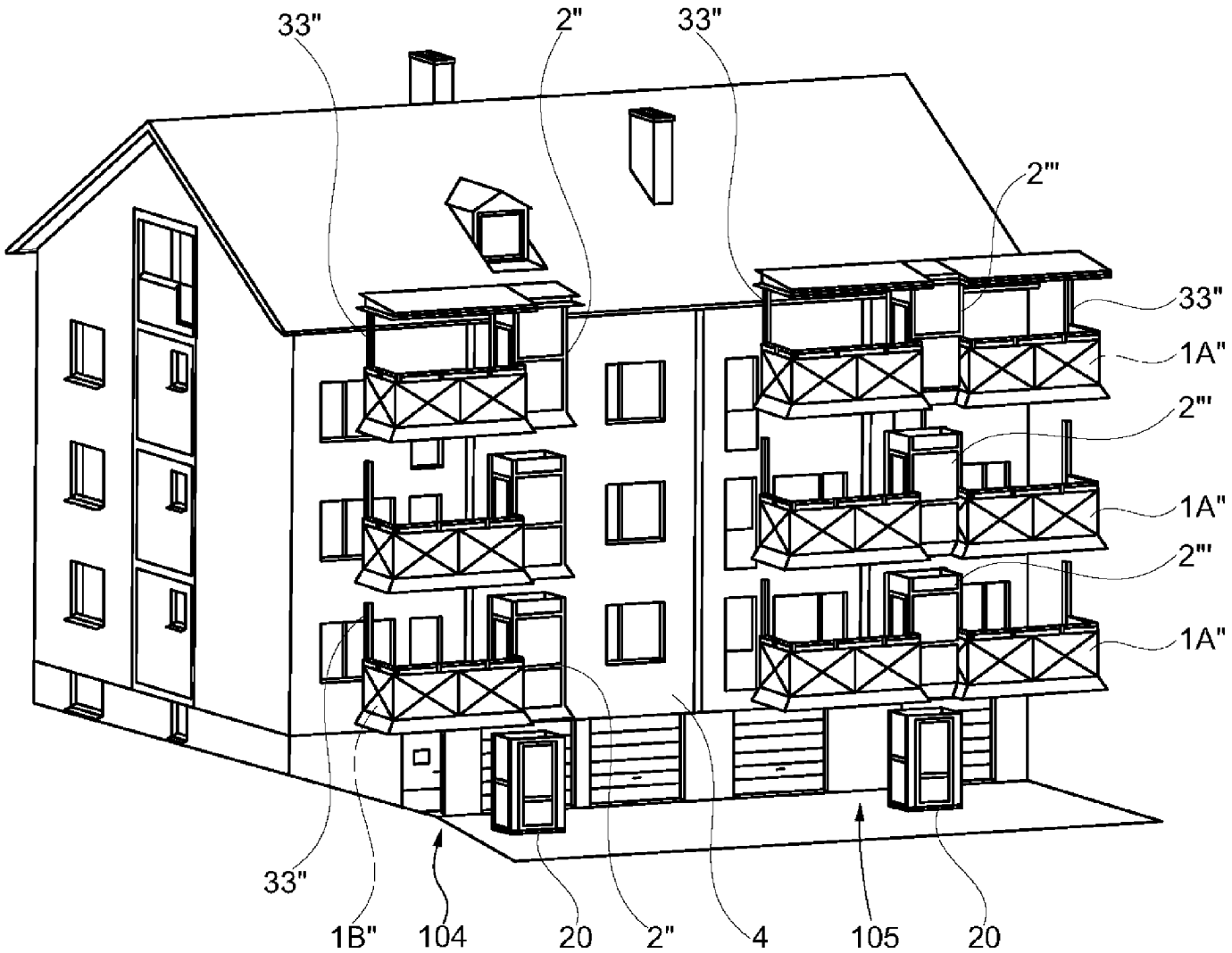
FIG. 4C shows alternative exemplary access systems comprising elevator module divided into elevator submodules and separate balcony submodules in a position for mounting on a wall of a building.

FIG. 4C shows alternative embodiments of access systems 104, 105 in which separate mounting means 33" are provided for each of a plurality of separate balcony modules 1B", 1B", 1B"; 1A", 1A", 1A", 1B", 1B", 1B", here only provided with railings, but of course, in alternative embodiment the balconies may comprise walls, e.g. comprise glass balconies, for separate mounting of each balcony module to a wall 4. In these embodiments the elevator modules comprise separate elevator submodules 2", 2'", one for each a plane. Separate, optionally additional, mounting means 3" are also provided for each elevator module for mounting to a common mounting arrangement fixed to the wall 4. To the left in FIG. 4C the separate elevator modules 2" are adapted for being associated with balcony modules on but one side thereof, whereas to the right in FIG. 4C an implementation is illustrated wherein each elevator submodule 2'" is adapted for being associated with two balcony modules, on two sides thereof, and hence comprises doors and openings on two sides. The bottom elevator submodules $\mathbf{2}_0$ comprise elevator entrance doors, which may be located in a side wall or in the front wall thereof (not shown).

Figure 4D:
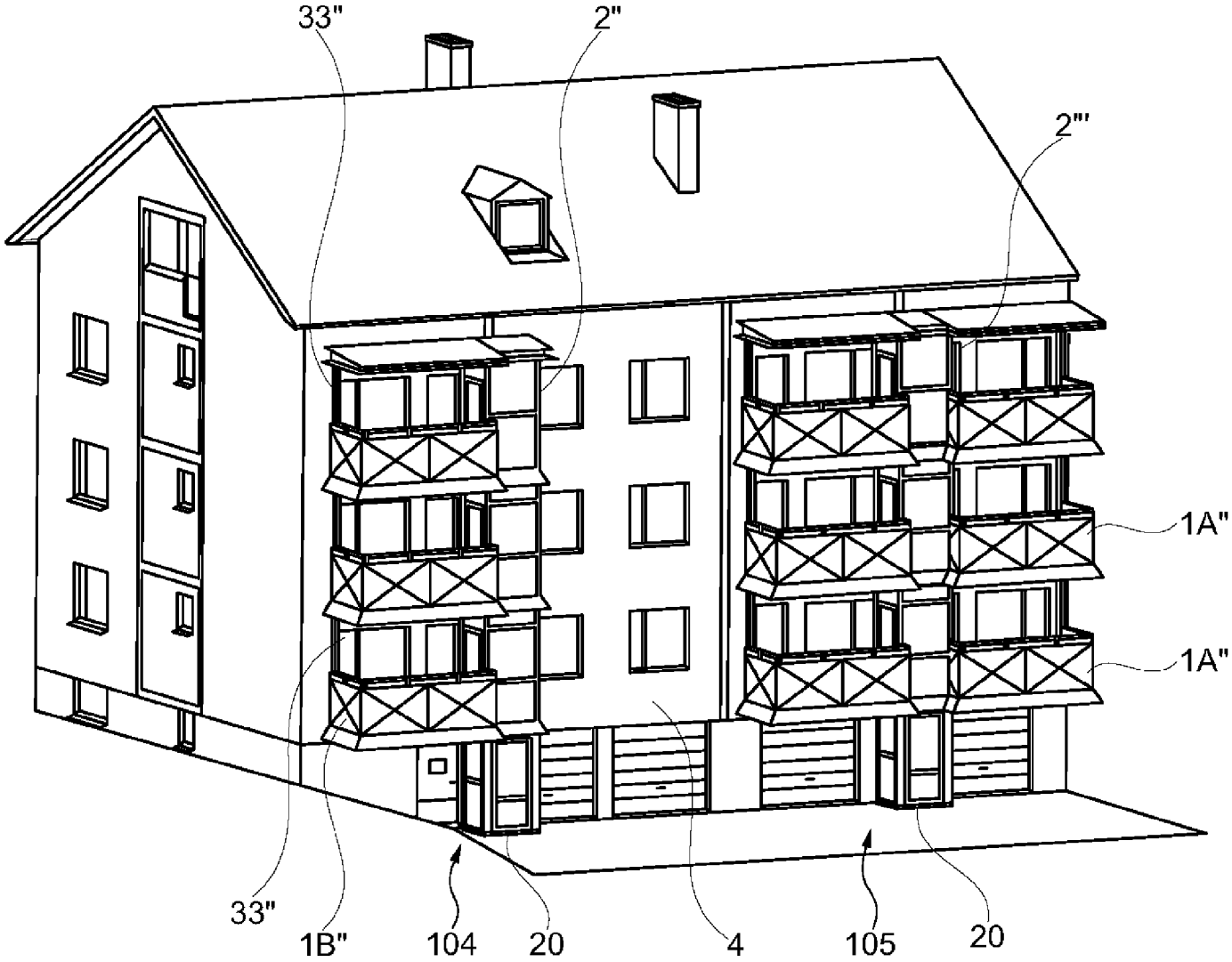
FIG. 4D shows the access systems of FIG. 4C in a mounted state on a wall.

FIG. 4D shows the access systems 104, 105 of FIG. 4C mounted on to the wall 4.

Figure 5:
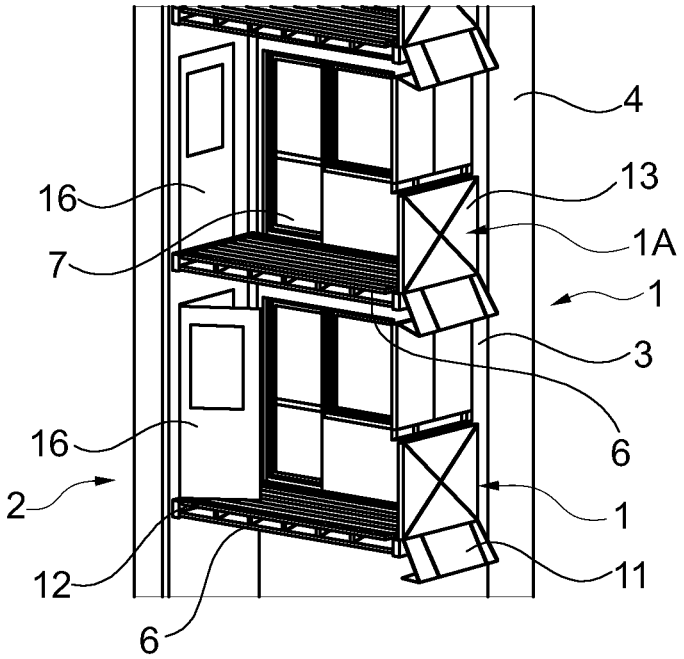
FIG. 5 is a simplified perspective view of an exemplary balcony module with the front wall removed.

FIG. 5 very schematically illustrates a section of a balcony module 1 e.g. as in FIG. 1, with the balcony front walls removed for illustrative purposes. As discussed above, a balcony module may comprise but one balcony 1A, or a plurality of balconies 1A, 1A. Similar elements bear the same reference numbers as in FIG. 1, and will not be further described. The balcony doors 16, 16 are arranged in respective side walls 13, 13 of the balconies 1A, 1A to provide access to an elevator module (not shown). In FIG. 1 are also shown the respective supporting floor frame structures 6 of each balcony 1A on top of each of which a grate floor 12 is disposed. Entrance doors 7 from the balconies to apartments or similar are provided for in any desired manner.

Figure 6:
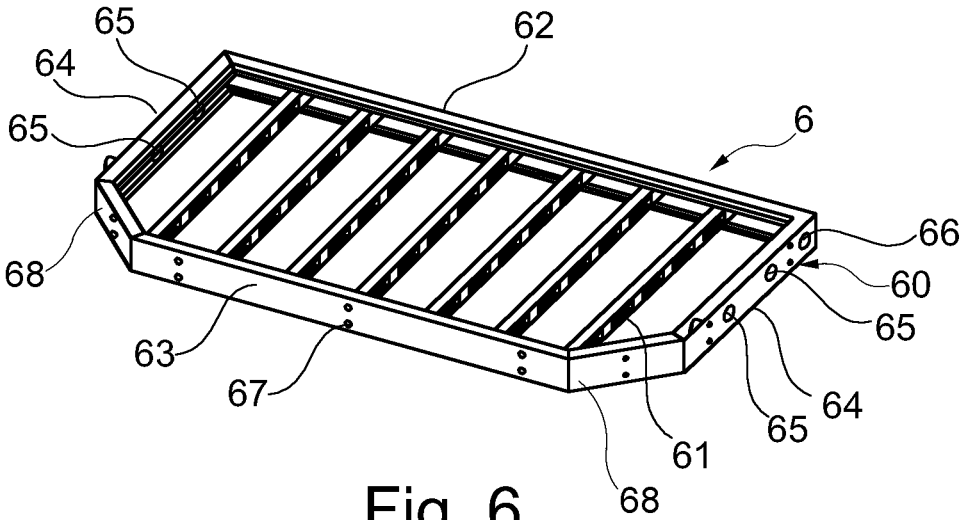
FIG. 6 is a view in perspective of a supporting frame structure of a balcony according to one embodiment.

FIG. 6 shows an exemplary supporting floor frame structure 6 of a balcony. It comprises an outer frame 60 with a rear section 62 adapted to be arranged horizontally along the wall of the building, a front section 63, two side sections 64 and a plurality of support beams 61 extending in parallel from the rear section 62 to the front section 63. The side sections 64, 64 are provided with holes 65 for connection to vertical beams of a mounting arrangement as will be discussed with reference to FIG. 8 below, and/or with holes 66 for connection to (second) vertical structural hollow sections of a mounting arrangement as will be discussed with reference to FIG. 7B below, according to different embodiments. The frame 60 also comprises holes 67 for connection of balcony walls (not shown).

Figure 7A:
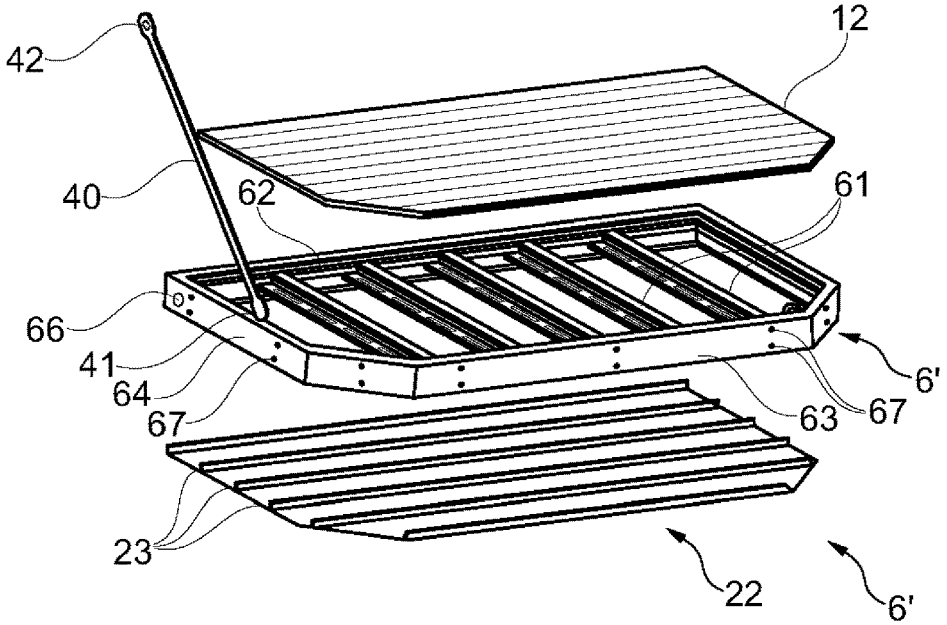
FIG. 7A shows a supporting frame structure as in FIG. 6 with a grate floor and an inner roofing for mounting to the supporting frame structure on opposite sides thereof.

FIG. 7A shows a supporting floor frame structure 6' substantially corresponding to the frame structure 6 of FIG. 6, comprising holes 66 for direct connection to second vertical structural hollow sections 33' by means of fastening means, and holes 69 for connection by means of additional fastening means to one end of a pull rod 40 via holes 41 provided therein, which pull rod in the opposite end comprises a hole 42 for connection by means of a fastening means to a corresponding second vertical structural hollow section 33'.

A grate floor 12 is adapted to be disposed on top of the supporting floor frame structure 6'.

A roofing structure 22 is connectable to the lower side of the supporting floor frame structure 6'. The roofing structure comprises ridges or seams, here disposed in parallel and extending in a direction from one side section 64 towards the other 64 of the frame structure 6'. It may be connected to the frame structure 6' in any appropriate manner, and it is adapted to form a roof of another balcony located below, unless it is the lowermost balcony, in which case it just forms a base plate or a bottom roof; the functioning is the same. One purpose of the ridges is to conduct water leaking through the grate floor and the frame structure towards the sides of the balcony. It may e.g. be made of sheet metal. In one embodiment it comprises corrugated metal.

Figure 7B:
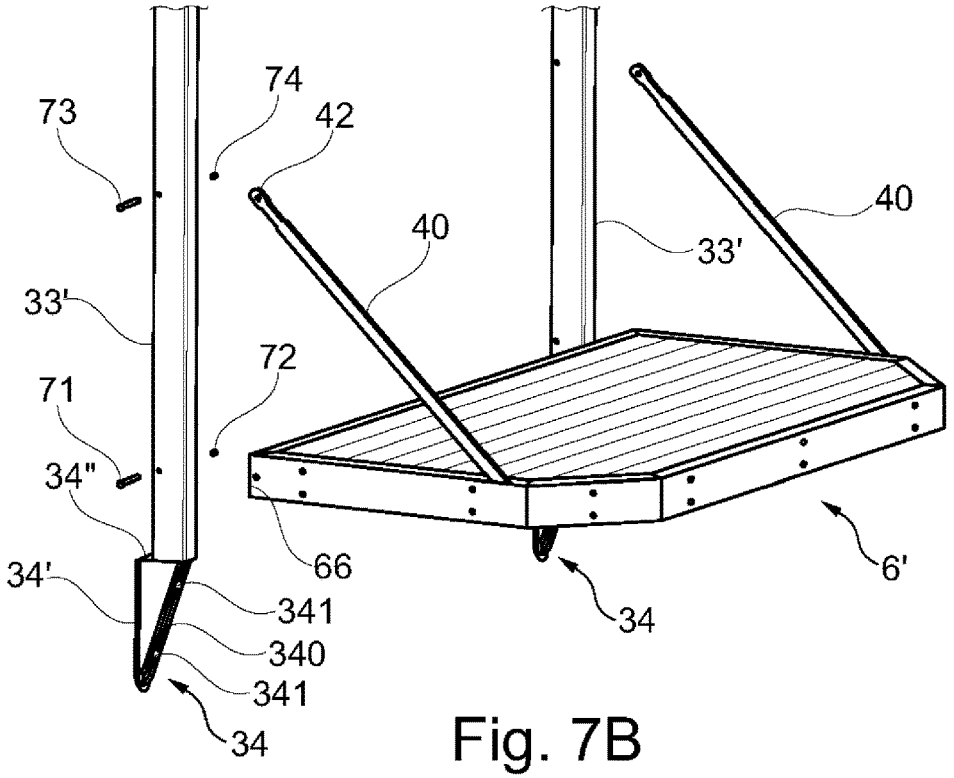
FIG. 7B shows the supporting frame structure with a grate floor and an inner roofing to be mounted to a mounting arrangement according to one embodiment of invention.

FIG. 7B shows the structures forming floor and roof of FIG. 7A in a mounted state, i.e. the supporting floor frame structure 6' with the grate floor 12 mounted on top of it and the roofing structure mounted beneath. In addition thereto the pull rod 40 has been connected to the frame structure, e.g. by means of screws and bolts or any other appropriate fastening means. The frame structure is connectable to two second vertical structural hollow sections 33', 33' disposed on either side of the frame structure by means of appropriate fastening means, e.g. comprising bolts 71 to be introduced into through holes in the second vertical structural hollow sections and through the holes 66 in the side sections 64 of the frame structure 6', and bolts 72. The opposite end of the pull rod 40 is correspondingly fastened to the vertical structural hollow section 33' by means of fastening means, i.e. screws 73 and bolts 74, or in any other appropriate manner.

In an advantageous embodiment the mounting arrangement further comprises console elements 34 having the shape of an inverted L and comprising a first leg portion 34' for connection to the wall of the building, and a second leg portion 34" disposed perpendicularly thereto onto which the second vertical structural hollow section 33' rests. The console element further comprises a wedge 340 adapted to the shape of the console element and comprising a number of through holes 341, 341 for bolting to the wall of the building.

In advantageous embodiments console elements similar to console elements 34 are also provided for providing additional support to first vertical structural hollow sections intended for supporting the elevator module.

Figure 7C:
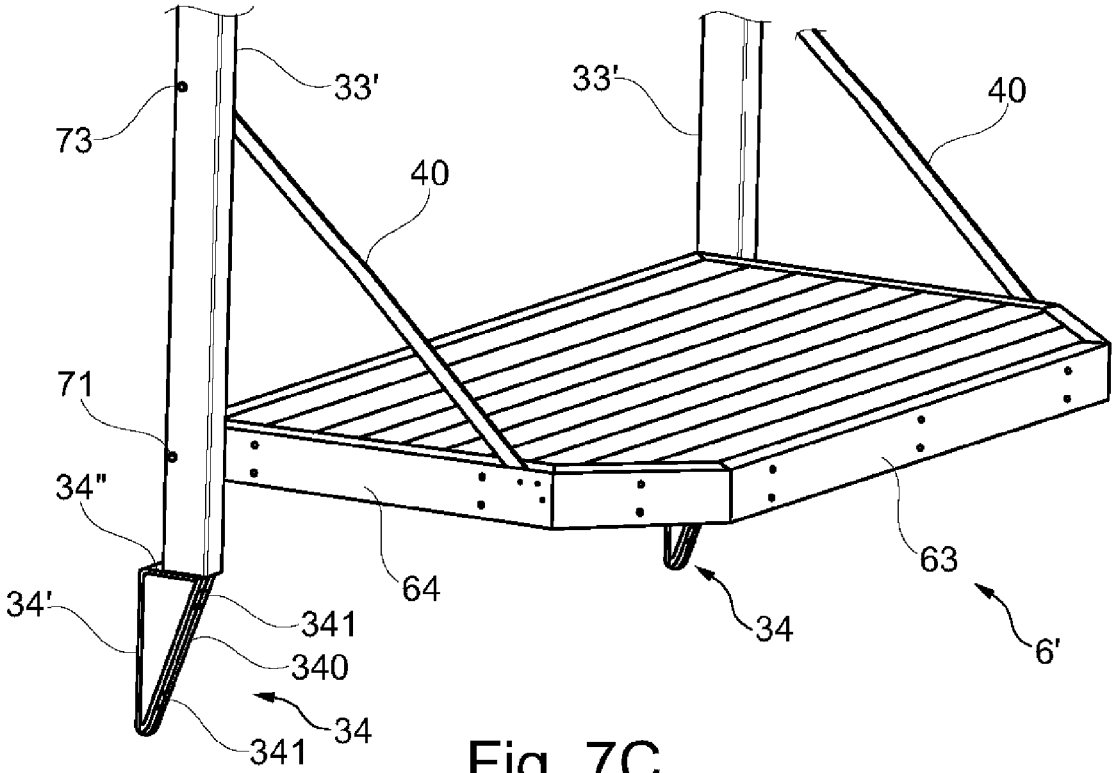
FIG. 7C shows the supporting frame structure with a grate floor and an inner roofing of FIG. 7B when mounted to the mounting arrangement, FIG. 8 schematically illustrates a vertical structural hollow section of a mounting arrangement for illustrative purposes with different (additional) connecting elements.

FIG. 7C shows the frame structure 6' of FIG. 7B mounted onto the second vertical structural hollow sections 33', 33', of the mounting arrangement.

Figure 8:
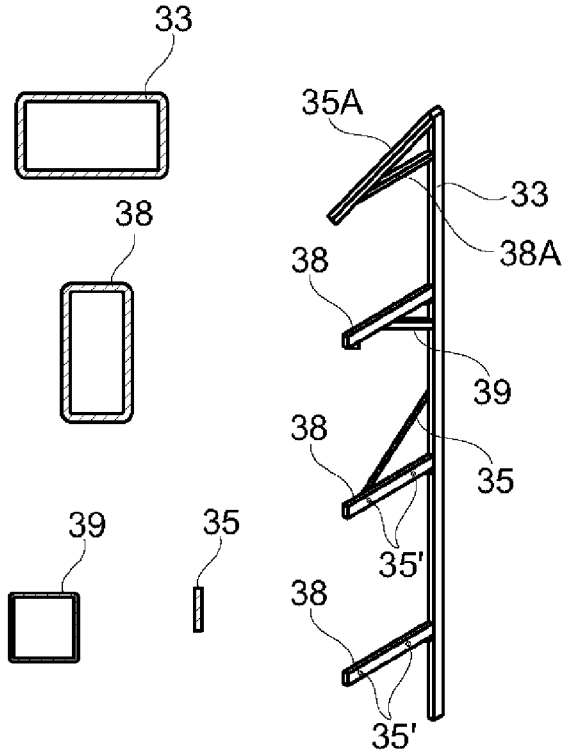

FIG. 8 is a schematic view showing a second vertical structural hollow section 33 onto which horizontal beams 38 are welded, or attached in any other appropriate manner, e.g. via cooperating coupling recesses and protrusions or similar (not shown). It should be clear that throughout the description, when referring to vertical and horizontal respectively, reference is made to the mounted state of the mounting arrangement, or the access system, i.e. when it is mounted onto a building. The horizontal beams 38 may in different embodiments be connected and further supported by one or more of pull rods 35, 35A, supporting struts 39 as illustrated in FIG. 8.

The frame structure 6 may here be connected to said horizontal beams by means of fastening elements (not shown), e.g. comprising bolts and nuts or similar, through mating holes 65 in the frame structure 6 and holes 35' in the horizontal beams 38 respectively. It should be clear that the pull-rods 35 cannot be provided on the side of a supporting floor frame structure facing an elevator module for practical reasons. It should also be clear that different additional supporting elements can be provided for in any desired manner also when the supporting floor frame structure (6, 6') is connected directly to second vertical structural hollow elements (33'), cf. FIGS. 7A-7C.

To the left in FIG. 8 exemplary cross-sections of beams, pull rod and struts are illustrated.

Figure 9:
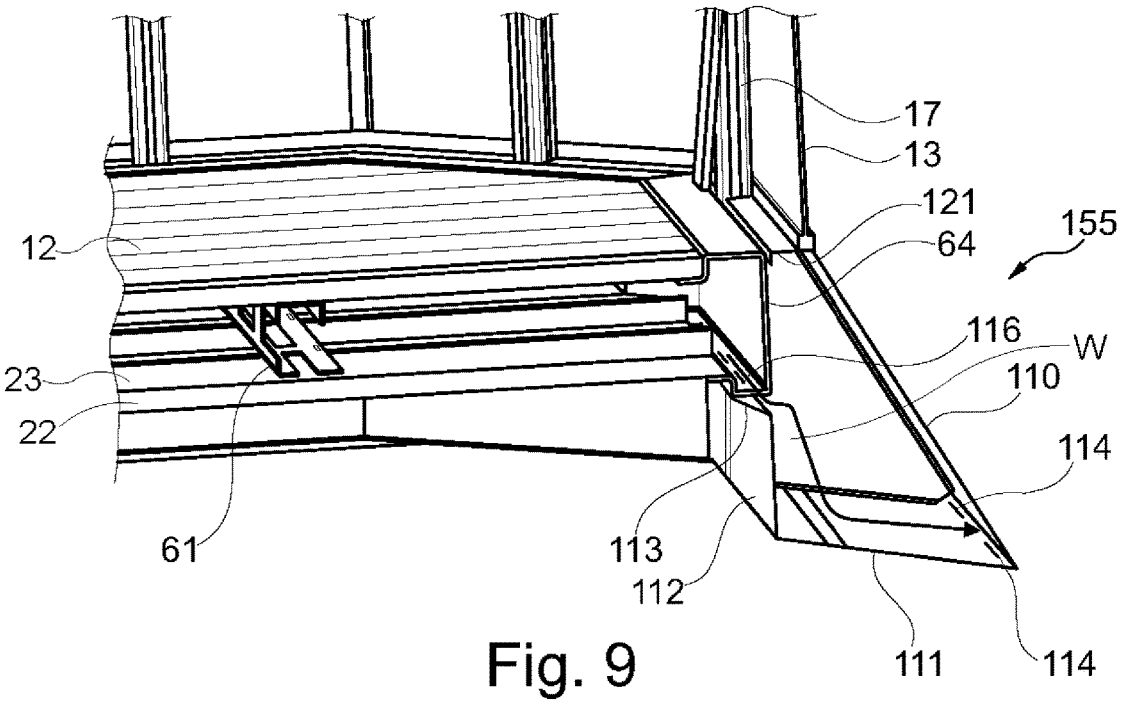
FIG. 9 is a very schematic cross-sectional view in perspective of a water protective arrangement connected to a balcony according to one embodiment.

FIG. 9 schematically illustrates a water protective arrangement 155 connected to the outer edges of a balcony and serving the dual purposes of leading off water collected on the balcony floor, e.g. rain water, or water accidentally or intentionally poured out on the balcony floor, and protecting an underlying balcony, terrace or wall from rain water incident obliquely towards the building. Water flowing through the grate floor 12 and the supporting frame structure is assembled on top of the inner roofing 22, which preferably comprises ridges or corrugations 23 assisting in leading the water towards the outer edges or portions of the balcony. The protective arrangement 105 is arranged to surround the outer front and side edges of the balcony; in FIG. 9 a view from the rear side of the balcony shows one of the side sections of the protective arrangement 105. The protective arrangement 155 comprises a bent plate structure comprising a first outer, outwardly sloping plate portion 110. In one embodiment said first outer, outwardly sloping plate portion 110 is attachable to the balcony by means of a flange portion 121 at its upper edge, preferably to the frame side section 64, and to the frame front section (not shown), (or to an interconnecting element in any appropriate manner, not shown), such that it will be connected inside the lower edges of the balcony walls 13. The balcony wall or railing 15 is (additionally) secured by means of a pillar 17 to the front and side sections 64 of the supporting frame structure.

The protective arrangement 155 further comprises a bottom plate portion 111 and a rear plate portion 112. The bottom plate portion 111 is connected to, or integral with, the outer lower edge of the front portion and is arranged to slope slightly outwards. It comprises a plurality of drainage holes 114 adjacent the interface with the outer plate portion 110 allowing water to flow out through said holes. At the opposite end of the bottom plate portion, and preferably integral therewith, the rear plate portion 112 extends, in a mounted state, substantially in parallel to the wall of the building, and at its upper edge being provided with an outwardly sloping water fall-off portion 113 adapted for connection to the lower side of an inner roofing 22, at the outer edges thereof, below the frame section 64. By means of holes 116 disposed in bottom edge portions of the frame sections, water is allowed to flow through said holes 116, onto the water fall-off portion 113, and down onto the outwardly sloping bottom portion 111 and out through the drainage holes 114 provided therein. The first outer plate portion 110 mainly protects against rain water falling in onto the building.

Figure 10:
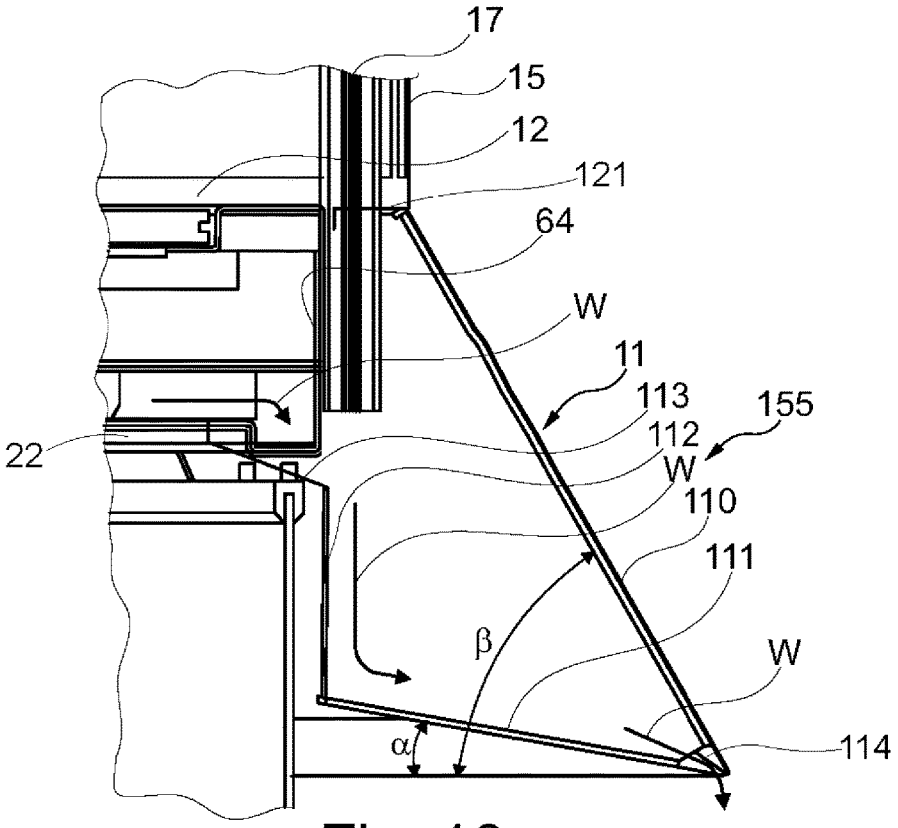
FIG. 10 is a cross-sectional view schematically illustrating the water protective arrangement and the water leading off functionality.

FIG. 10 is a side view of the water protective arrangement shown in FIG. 9. The arrows indicated w schematically illustrate the flow-off of water. Similar elements bear the same reference numerals as in FIG. 9 and will not be further discussed herein.

As discussed with reference to FIG. 9 the first, outer, plate portion 110 is arranged to slope outwards, forming an angle $\beta$ with a plane perpendicular to the wall of the building, here shown as the angle with the upper portion of a balcony wall of a balcony located below. Correspondingly the bottom plate portion 111 forms an angle $\alpha$, smaller than $\beta$, with said wall. The angles may take different values which are not critical as such as long as water is allowed to flow off in an efficient manner, and, as far as $\beta$ is concerned, it is capable of assuring that incident water is hindered from entering sideways into the structure and to some extent onto at least an upper portion of an underneath located balcony wall or similar. As an example only, $\beta$ may be between 30° and 75°, whereas a may be between 5° and 30°. It should however be clear that these figures merely are given for exemplifying, and by no means limiting purposes.

Also the elevator module, or respective elevator submodules, may be provided with corresponding or similar water protective arrangements.

It should be clear that the invention is not limited to the explicitly illustrated embodiments but that it can be freely varied within the scope of the appended claims.

For mounting of the building access system on an existing building, old balconies (if any) are removed. If the building does not comprise any balconies, doors need to be taken up in the wall, or a window be replaced. If so called French balconies are provided, such doors may with advantage be used.

The building access system may comprise partially or entirely integrated mounting arrangements, or entirely separate mounting arrangements. It is also not restricted to any particular mounting arrangements as long as it can be securely, reliably, and easily mounted onto a wall of a building, and further allows secure and reliable and easy mounting of the elevator and balcony modules thereto.

It may be provided as substantially pre-fabricated modules for transportation to the building where it is to be mounted, or as separate elements.

A module may also comprise an integrated module comprising an elevator module and one or more balcony modules, on more than one side of the elevator module, or on one side only, and/or with balconies in one or more planes (vertically seen in a mounted state).

The building access system may further be provided with a water protective arrangement or not. It should also be clear that the water protective arrangement can be used as a separate entity that can be added, or be built in from the beginning. The water protective arrangement can also be used with other types of balconies, glass balconies or not. It may also be fabricated as an optional add-on product, applicable for many different types of balconies, or other types of platforms etc.

It is a particular advantage of the invention that a building needing to be provided with an elevator, will through the inventive concept at the same time be provided with balconies, or if balconies were already provided, with new balconies, which adds considerably to the value and comfort of the building.

A further advantage resulting from the invention is that one or more extra floors may be cost efficiently added on top of existing, lower buildings, e.g. on top of 2, 3 or more storey buildings. It is estimated that the cost for such an addition can be achieved at a cost that is about 50% in comparison with new production.

It is also an advantage that a very easy access to an elevator is provided from each apartment or office or similar.

The invention claimed is:

1. A building access system (100; 101; 102; 103; 104; 105; 106; 107), adapted to be arranged externally of a building comprising a number of stories, comprising:

an elevator module (2; 2'; 2"; 2''') with an elevator shaft (2A) for an elevator and a mounting arrangement (3; 3'; 3"; 3'''; 3''''), and further comprising at least one balcony module (1; 1'; 1B'; 1B'; 1B'; 1B'; 1B'; 1B'; 1A'; 1A'; 1A'; 1B"; 1B"; 1B"; 1B"; 1B"; 1B"; 1A"; 1A"; 1A"), the at least one balcony module comprising one or more balconies (1A; 1B; 1B; 1B), each said one or more balconies comprising an opening or a balcony door (16) for providing direct access to the elevator module (2; 2'; 2"; 2''') from a side of each said one or more balconies, wherein at least part of the mounting arrangement (3; 3'; 3"; 3'; 3'''') is adapted to be connected to a wall (4) of the building or to at least one of a plurality of mounting elements (36, 36) connected to the wall (4) of the building and being carried or suspended by said wall (4) of the building or said at least one of the plurality of mounting elements (36, 36) connected to the wall (4) of the building, the at least one balcony module being adapted to be connected to the building by the mounting arrangement (3; 3'; 3"; 3'''; 3'''') and being supported or carried by the mounting arrangement (3; 3'; 3"; 3'''; 3'''') or part (3A) of the mounting arrangement connected to the building, and the mounting arrangement (3; 3'; 3"; 3'''; 3'''') interconnecting the one or more balconies of the building access system with the wall (4) of the building, the elevator module being exclusively mounted to the wall of the building, and the elevator module (2; 2'; 2"; 2''') and the one or more balconies or the at least one balcony module further comprising one or more separate balcony modules, or the elevator module and the one or more balconies or the at least one balcony module comprising one or more integrated modules comprising the elevator module and the at least one balcony-module; further comprising carrying elements which are adapted to be arranged at a frame side section (64) facing away from the elevator module (2; 2'; 2"; 2''') and which comprise pull-rods (35; 35A; 40) having outer ends connected to said one of the plurality of mounting elements of the mounting arrangement comprising a vertical structural section (33; 33'; 33") at a respective point located above a point at which the frame side section (64) is connected to the vertical structural section, via a horizontal carrying beam (38).

2. The building access system according to claim 1, wherein the mounting arrangement (3; 3'; 3"; 3'''; 3') comprises a plurality of vertical structural, sections (31; 33; 33'; 33"; 33') adapted for connection to the wall (4) of the building or to a second, suspending one of said plurality of mounting elements (36, 36) connected to the wall, or connected by one or more vertical structural, section fasteners to, or forming part of, an attic joist floor of the building, the at least one balcony module being adapted to be connectable to the wall (4) of the building by one or more balcony module fasteners or to said plurality of vertical structural sections connected to the building, the one or more vertical structural sections (31; 33; 33'; 33"; 33'''') being adapted to be disposed to interconnect respective opposite rear outer edges of the at least one balcony module with the wall (4) of the building.

3. The building access system according to claim 2, wherein the elevator module (2; 2'; 2"; 2''') is adapted to be connected to the wall (4) of the building by the mounting arrangement (3; 3'; 3"; 3''''), the mounting arrangement (3; 3'; 3"; 3'''') further being adapted for connecting the elevator module (2; 2'; 2"; 2''') and one of the one or more balconies or the at least one balcony module such that the direct access is provided between the elevator shaft (2') and each of the one or more balconies, and that the elevator module (2; 2'; 2"; 2''') is adapted to be connectable to the wall (4) of the building by one or more elevator module fasteners or to said plurality of vertical structural sections connected to the building.

4. The building access system according to claim 3, wherein an additional two of the plurality of vertical structural, sections of the mounting arrangement (3; 3'; 3") are disposed in the elevator module forming the elevator shaft (2A), at a distance from each other on a rear side of the elevator shaft (2A) for connection to the wall (4) of the building.

5. The building access system according to claim 4, wherein the at least one balcony module is adapted to be connected to a second one or more of the plurality of vertical structural sections (31; 33; 33'; 33"; 33'''') of said mounting arrangement (3; 3'; 3").

6. The building access system according to claim 1, wherein said building access system comprises at least two of said one or more balconies or at least two of said at least one balcony modules (1A; 1A; 1A; 1B; 1B; 1B; 1B'; 1B'; 1B; 1A'; 1A'; 1A'; 1A'; 1A"; 1B") which are arranged above one another in a mounted state of the building access system for serving different stories, the at least two of said one or more balconies being comprised in separate ones of said at least two of the at least one balcony module, each of said separate ones of said at least two of the at least one balcony module comprising one of said at least two of said one or more balconies or in an integrated module comprising said at least two of said one or more balconies and one additional balcony or one of said at least two balconies and an elevator module (1B", 2").

7. The building access system according to claim 6, wherein said building access system comprises three or more of said one or more balconies or of said at least one balcony module (1A; 1A; 1A; 1B; 1B; 1B; 1B'; 1B'; 1B; 1A'; 1A'; 1A'; 1A'; 1A"; 1B") which are arranged above one another in a mounted state of the building access system for serving different stories, the at least three of said balconies being comprised in separate ones of said three or more balcony modules, each of said three or more balcony modules comprising one balcony or in an integrated module comprising three or more balconies.

8. The building access system according to claim 1, wherein the building access system comprises, in at least one plane or story, two balconies or balcony modules (1A; 1B; 1A'; 1B'; 1A"; 1B") which are located on opposite sides of the elevator shaft (2A).

9. The building access system according to claim 1, wherein the building access system comprises an integrated elevator and balcony module (1B", 2") with the one or more balconies disposed on one, two or three sides of the elevator module (2").

10. The building access system according to claim 1, wherein the one or more balconies comprise a supporting floor frame structure (6; 6') comprising a rear frame section (62) adapted to be arranged horizontally along the wall (4) of the building, a front section (67) of the supporting floor frame structure and two side sections (64, 64) of the supporting floor frame structure.

11. The building access system according to claim 10, wherein a rear end of a first one of said two side sections (64) of the supporting floor frame structure facing away from a side of the supporting floor frame structure at which the elevator module (2; 2'; 2"; 2'") is disposed, is located adjacent an inner side of a second vertical structural section (33'), and adapted to be connectable thereto by a cooperating fastening arrangement (66, 71, 72).

12. The building access system according to claim 11, wherein a rear end of a second one of said two side section sections (64), which is to be located next to a position of the elevator module (2; 2'; 2"; 2'") in a mounted state of the building access system, is located adjacent an inner side of a second vertical structural section (33'), and adapted to be connectable thereto by a cooperating fastening arrangement (66, 71, 72), or to one of the plurality of vertical structural sections (3'; 33").

13. The building access system according to claim 12, the wherein a second vertical structural hollow section (33) of the plurality of vertical structural sections, comprises a horizontal carrying (38) beam disposed perpendicularly to the second vertical structural section and adapted to protrude from the wall (4) of the building and form an angle of substantially 90° to the wall (4) of the building in a mounted state of the building access system, and in that said horizontal carrying beam (38) is fixedly connected to the second vertical structural section by welding.

14. The building access system according to claim 11, wherein the supporting floor frame structure (6) is adapted to be connected to, or carried by, two horizontal carrying beams (38).

15. The building access system according to claim 14, wherein the two side sections (64,64) of the supporting floor frame structure are connectable to the horizontal carrying beams (38), the horizontal carrying beam (38) being disposed along said two side sections (64,64).

16. The building access system according to claim 15, comprising additional carrying elements (39; 39A; 35; 40) each having one end connected to the two side sections (64, 64) of the supporting floor frame structure (6; 6') interfacing the front section (63) or an intermediate corner section (14) of the supporting floor frame structure (6; 6') at a location spaced nearer an outer edge than an inner edge of the respective side sections (64, 64) of the supporting floor frame structure (6; 6'), and each of the additional carrying elements having an opposite end connected to mounting elements of the mounting arrangement (3; 3'; 3"), to which a respective inner edge of the two side sections (64, 64) are connected at a predetermined distance from a connection of the respective inner edge of the two side sections (64, 64) to the mounting arrangement (3; 3'; 3").

17. The building access system according to claim 16, wherein at least some of said additional carrying elements comprise supporting struts (39) connected to a point below a point at which the inner edge of a side section (64) of the two side sections (64, 64) is connected, via a horizontal carrying beam (38).

18. The building access system according to claim 16, wherein the frame side section facing away from the elevator module (2; 2'; 2"; 2'") is additionally connected to a vertical structural section of the plurality of vertical structural sections (33; 33'; 33") by pull-rods (35; 35A; 40) and/or supporting struts (39).

19. The building access system according to claim 1, comprising console elements (34) connectable to the wall of a building, and in that lower ends of at least some mounting elements (3; 33; 33'; 33"; 3', 31, 32) of the mounting arrangement for mounting of the building access system are adapted to be arranged to rest thereon in a mounted state of the building access system.

20. The building access system according to claim 2, wherein first ones of the plurality of vertical structural sections (3') are L-shaped, a lower end of each of said first ones of the plurality of vertical structural sections comprising a first leg section (31) extending vertically along the wall of the building in a mounted state of the building access system and a second leg section (32) forming an angle of 90° with the first leg section (31), and in a said mounted state, the second leg section (32) is arranged to rest on a second leg section (34") of a console element (34), the console element (34) having a shape of an inverted L with a wedge (340) disposed within a first leg section of the console element and said second leg section (34', 34") of the console element forming the L-shape of the console element (34).

21. The building access system according to claim 10, wherein the supporting floor frame structure (6; 6') comprises a number of horizontal beams (61) extending in parallel from the rear frame section (62) to a front frame section (63), a grate floor (12) adapted to be located on top of the supporting floor frame structure (6; 6'), and a roofing element (22) being adapted to be connected to a lower side of the supporting floor frame structure (6; 6'), forming an inner roof of a first one of said one or more balconies disposed below a second one of said one or more balconies, each of said first and second ones of said one or more balconies further comprising a wall arrangement at least comprising a front wall (15), a first and a second side wall (13, 13), the balcony door (16) leading to the elevator shaft (2A) being disposed in a respective first side wall (13, 13) of said first and second ones respectively of said one or more balconies.

22. A building access system (100; 101; 102; 103; 104; 105; 106; 107), adapted to be arranged externally of a building comprising a number of stories, comprising:

an elevator module (2; 2'; 2"; 2'") with an elevator shaft (2A) for an elevator and a mounting arrangement (3; 3'; 3"; 3'"; 3""), and further comprising at least one balcony module (1; 1; 1'; 1B'; 1B'; 1B'; 1B'; 1B'; 1A';

1A'; 1A'; 1B"; 1B"; 1B"; 1B"; 1B"; 1B"; 1A"; 1A"; 1A"), the at least one balcony module comprising one or more balconies (1A; 1B; 1B; 1B), each said one or more balconies comprising an opening or a balcony door (16) for providing direct access to the elevator module (2; 2'; 2"; 2'") from a side of each said one or more balconies, wherein at least part of the mounting arrangement (3; 3'; 3"; 3'"; 3"") is adapted to be connected to a wall (4) of the building or to at least one of a plurality of mounting elements (36, 36) connected to the wall (4) of the building and being carried or suspended by said wall (4) of the building or said at least one of the plurality of mounting elements (36, 36) connected to the wall (4) of the building, the at least one balcony module being adapted to be connected to the building by the mounting arrangement (3; 3'; 3"; 3'"; 3"") and being supported or carried by the mounting arrangement (3; 3'; 3"; 3'"; 3"") or part (3A) of the mounting arrangement connected to the building, and the mounting arrangement (3; 3'; 3"; 3'"; 3"") interconnecting the one or more balconies of the building access system with the wall (4) of the building, the elevator module being exclusively mounted to the wall of the building, and the elevator module (2; 2'; 2"; 2'") and the one or more balconies or the at least one balcony module further comprising one or more separate balcony modules, or the elevator module and the one or more balconies or the at least one balcony module comprising one or more integrated modules comprising the elevator module and the at least one balcony-module;

wherein said the one or more balconies comprise a supporting floor frame structure (6; 6') comprising a rear frame section (62) adapted to be arranged horizontally along the wall (4) of the building, a front section (67) of the supporting floor frame structure and two side sections (64, 64) of the supporting floor frame structure;

wherein a rear end of a first one of said two side sections (64) of the supporting floor frame structure facing away from a side of the supporting floor frame structure at which the elevator module (2; 2'; 2"; 2") is disposed, is located adjacent an inner side of a vertical structural section (33'), and adapted to be connectable thereto by a cooperating fastening arrangement (66, 71, 72);

wherein the supporting floor frame structure (6) is adapted to be connected to, or carried by, two horizontal carrying beams (38);

wherein the two side sections (64,64) of the supporting floor frame structure are connectable to the horizontal carrying beams (38), the horizontal carrying beam (38) being disposed along said two side sections (64, 64);

further comprising carrying elements (39; 39A; 35; 40), each having one end connected to the two side sections (64, 64) of the supporting floor frame structure (6; 6') interfacing a front section (63) or an intermediate corner section (14) of the supporting floor frame structure (6; 6') at a location spaced nearer an outer edge than an inner edge of respective ones of the two side sections (64, 64) of the supporting floor frame structure (6; 6'), and each of the additional carrying elements having an opposite end connected to mounting elements of the mounting arrangement (3, 3'; 3"), to which a respective inner edge of the two side sections (64, 64) is connected at a predetermined distance from a connection of the respective inner edge of the two side sections (64, 64) to the mounting arrangement (3; 3'; 3"), and wherein at least some of said carrying elements which are adapted to be arranged at a frame side section (64) facing away from the elevator module (2; 2'; 2"; 2'") comprise pull-rods (35; 35A; 40), that said pull-rods (35; 35A; 40) have outer ends connected to a mounting element of the mounting arrangement comprising a vertical structural section (33; 33'; 33") at a respective point located above the point at which the frame side section (64) is connected to the vertical structural section, via a horizontal carrying beam (38).

23. A building access system (100; 101; 102; 103; 104; 105; 106; 107), adapted to be arranged externally of a building having a number of stories 1, comprising:

an elevator module (2; 2'; 2"; 2'") with an elevator shaft (2A) for an elevator and a mounting arrangement (3; 3'; 3"; 3"; 3""), and further comprising at least one balcony module (1; 1; 1'; 1B'; 1B'; 1B'; 1B'; 1B'; 1B'; 1A'; 1A'; 1A'; 1B"; 1B"; 1B"; 1B"; 1B"; 1B"; 1A"; 1A"; 1A"), the at least one balcony module comprising one or more balconies (1A; 1B; 1B; 1B), each said one or more balconies comprising an opening or a balcony door (16) for providing direct access to the elevator module (2; 2'; 2"; 2'") from a side of each said one or more balconies, wherein at least part of the mounting arrangement (3; 3'; 3"; 3'"; 3"") is adapted to be connected to a wall (4) of the building or to at least one of a plurality of mounting elements (36, 36) connected to the wall (4) of the building and i-s being carried or suspended by said wall (4) of the building or said at least one of the plurality of mounting elements (36, 36) connected to the wall (4) of the building, the at least one balcony module being adapted to be connected to the building by the mounting arrangement (3; 3'; 3"; 3'"; 3"") and being supported or carried by the mounting arrangement (3; 3'; 3"; 3'"; 3"") or part (3A) of the mounting arrangement connected to the building, and the mounting arrangement (3; 3'; 3"; 3'"; 3"") interconnecting the one or more balconies of the building access system with the wall (4) of the building, the elevator module being exclusively mounted to the wall of the building, and the elevator module (2; 2'; 2"; 2'") and the one or more balconies or the at least one balcony module further comprising one or more separate balcony modules, or the elevator module and the one or more balconies or the at least one balcony module comprising one or more integrated modules comprising the elevator module and the at least one balcony-module;

wherein said the one or more balconies comprise a supporting floor frame structure (6; 6') comprising a rear frame section (62) adapted to be arranged horizontally along the wall (4) of the building, a front section (67) of the supporting floor frame structure and two side sections (64, 64) of the supporting floor frame structure:

wherein the supporting floor frame structure (6; 6') comprises a number of horizontal beams (61) extending in parallel from the rear frame section (62) to a front frame section (63), a grate floor (12) adapted to be located on top of the supporting floor frame structure (6, 6'), and a roofing element (22) being adapted to be connected to a lower side of the supporting floor frame structure (6, 6'), forming an inner roof of a first one of said one or more balconies disposed below a second one of said one or more balconies, each of said first and second ones of said one or more balconies further comprising a wall arrangement at least comprising a front wall (15), a first and a second side wall (13, 13), the balcony door (16) leading to the elevator shaft (2A) being disposed in a respective first side wall (13, 13) of said first and second ones respectively of said one or more balconies, and wherein each of said one or more balconies further comprises a protective arrangement (105) comprising a bent plate structure of metal, for protection against water and supporting water flow-off, said bent plate structure comprising a first outer, outwardly sloping, plate portion (110), attachable by a flange (121) disposed at an upper edge of each of said one or more balconies and along upper sides of the two side sections and front frame section of the supporting floor frame structure (6; 6'), on inner sides of lower edges of the first and second side walls (13, 13), a bottom plate portion (111), interconnecting a rear plate portion (112) with the first, outer, plate portion (110), said bottom plate portion (111) sloping outwards from said rear plate portion (112) and further being provided with drainage holes (114) proximate an interface with the first, outer, plate portion (110) allowing water to flow through said drainage holes, and said rear plate (112) portion comprising an upper, fall-off portion (113) having a greater slope than said bottom plate portion being attached below the roofing element (22).

24. A building access system (100; 101; 102; 103; 104; 105; 106; 107), adapted to be arranged externally of a building comprising a number of stories, comprising:

an elevator module (2; 2'; 2"; 2''') with an elevator shaft (2A) for an elevator and a mounting arrangement (3; 3'; 3"; 3'''; 3''''), and further comprising at least one balcony module (1; 1; 1'; 1B'; 1B'; 1B'; 1B'; 1B'; 1B'; 1A'; 1A'; 1A'; 1B"; 1B"; 1B"; 1B"; 1B"; 1B"; 1A"; 1A"; 1A"), the at least one balcony module comprising one or more balconies (1A; 1B; 1B, 1B), each said one or more balconies comprising an opening or a balcony door (16) for providing direct access to the elevator module (2; 2'; 2"; 2''') from a side of each said one or more balconies, wherein at least part of the mounting arrangement (3; 3'; 3"; 3'''; 3'''') is adapted to be connected to a wall (4) of the building or to at least one of a plurality of mounting elements (36, 36) connected to the wall (4) of the building and being carried or suspended by said wall (4) of the building or said at least one of the plurality of mounting elements (36, 36) connected to the wall (4) of the building, the at least one balcony module being adapted to be connected to the building by the mounting arrangement (3; 3'; 3"; 3'''; 3'''') and being supported or carried by the mounting arrangement (3; 3'; 3"; 3'''; 3'''') or part (3A) of the mounting arrangement connected to the building, and the mounting arrangement (3; 3'; 3"; 3'''; 3'''') interconnecting the one or more balconies of the building access system with the wall (4) of the building, the elevator module being exclusively mounted to the wall of the building, and the elevator module (2; 2'; 2"; 2''') and the one or more balconies or the at least one balcony module further comprising one or more separate balcony modules, or the elevator module and the one or more balconies or the at least one balcony module comprising one or more integrated modules comprising the elevator module and the at least one balcony-module;

wherein each of said one or more balconies further comprises a protective arrangement (105) comprising a bent plate structure of metal, for protection against water and supporting water flow-off, said bent plate structure comprising a first outer, outwardly sloping, plate portion (110), attachable by a flange (121) disposed at an upper edge of each of said one or more balconies and along upper sides of side and front frame sections of a supporting floor frame structure (6: 6') of said one or more balconies, on inner sides of lower edges of first and second side walls (13, 13) of said one or more balconies, a bottom plate portion (111), interconnecting a rear plate portion (112) with the first, outer, plate portion (110), said bottom plate portion (11) sloping outwards from said rear plate portion (12) and further being provided with drainage holes (114) proximate an interface with the first, outer, plate portion (110) allowing water to flow through said drainage holes, and said rear plate (12) portion comprising an upper, fall-off portion (113) having a greater slope than said bottom plate portion being attached below the roofing element (22) of said one or more balconies.

* * * * *